US006250749B1

(12) United States Patent
Merz et al.

(10) Patent No.: US 6,250,749 B1
(45) Date of Patent: Jun. 26, 2001

(54) INK CARTRIDGE WITH OVERFLOW CONDUIT

(75) Inventors: Eric A. Merz, Webster; Hiep H. Nguyen; Edward M. Carrese, both of Rochester; Dennis M. Lengyel, Hemlock, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/616,572

(22) Filed: Jul. 14, 2000

(51) Int. Cl.[7] ..... B41J 2/175
(52) U.S. Cl. ..... 347/86
(58) Field of Search ..... 347/84, 85, 86, 347/87; 53/474

(56) References Cited

U.S. PATENT DOCUMENTS

| | | | | |
|---|---|---|---|---|
| 4,677,448 | * | 6/1987 | Mizusawa et al. | 347/85 |
| 5,289,212 | | 2/1994 | Carlotta | 347/86 |
| 5,875,615 | * | 3/1999 | Ito et al. | 53/474 |
| 5,953,030 | * | 9/1999 | Ishinaga et al. | 347/86 |
| 5,997,121 | | 12/1999 | Altfather et al. | 347/7 |

FOREIGN PATENT DOCUMENTS 06226390 4/1996 (JP) .

* cited by examiner

*Primary Examiner*—N. Le
*Assistant Examiner*—Anh T. N. Vo
(74) *Attorney, Agent, or Firm*—David J. Arthur

(57) ABSTRACT

A fluid cartridge, such as a cartridge for filling with ink for use in ink jet printhead includes a housing enclosing a wick chamber, the housing including a top wall. The housing also includes an ink chamber. A fluid conduit connects the ink chamber and the wick chamber. The outer surface of the top wall of the housing is formed with a recess. A vent opening through the top wall of the wick chamber, at the recess, provides communication between the wick chamber and the recess. A covering over the top surface of the housing encloses the recess. An outlet opening through an outer wall other than the top wall of the wick chamber provides fluid communication for the ink to flow from the wick chamber. One end of an overflow tube is in fluid communication with the recess in the top wall of the housing. The other end of the overflow tube opens to the ambient environment at another point on the exterior of the housing near the outlet opening so that the potential "wet" spots on the exterior of the cartridge are in the same area.

15 Claims, 2 Drawing Sheets

INK CARTRIDGE WITH OVERFLOW CONDUIT

BACKGROUND OF THE INVENTION

The present invention relates to cartridges used in supplying liquid ink to a printhead in a thermal ink jet printing apparatus.

Thermal ink jet printing is well understood in the art. U.S. Pat. No. 5,997,121 describes several aspects of such printing.

In existing thermal ink jet printing, the printhead comprises one or more ink filled channels communicating with a relatively small supply chamber, or manifold, at one end, and having an opening at the opposite end, referred to as a nozzle. In current practical embodiments of drop on demand thermal ink jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure", exist in each of the nozzles and, by extension, within the ink supply manifold of the printhead. The attributes of creating and maintaining such back pressure are described in the U.S. Pat. No. 5,289,212, the contents of which are incorporated herein by reference.

The ink is supplied to the printhead from an ink cartridge. The ink cartridge contains a supply of ink, and is typically configured to maintain the required negative pressure. The ink cartridge is typically a user-replaceable unit that mates with the printhead of the printing apparatus.

SUMMARY OF THE INVENTION

The present invention is a fluid cartridge, such as an ink cartridge for an ink jet printhead. The cartridge includes a housing having a plurality of walls to define an interior chamber. A vent opening extends through one of the housing walls to provide fluid communication into the interior chamber. An outlet opening through one of the housing walls provides fluid communication into the interior chamber. A fluid conduit has a first end near the vent opening and a second end near the outlet opening from the chamber.

DETAILED DESCRIPTION OF A PREFERRED EMBODIMENT

Figure 1:
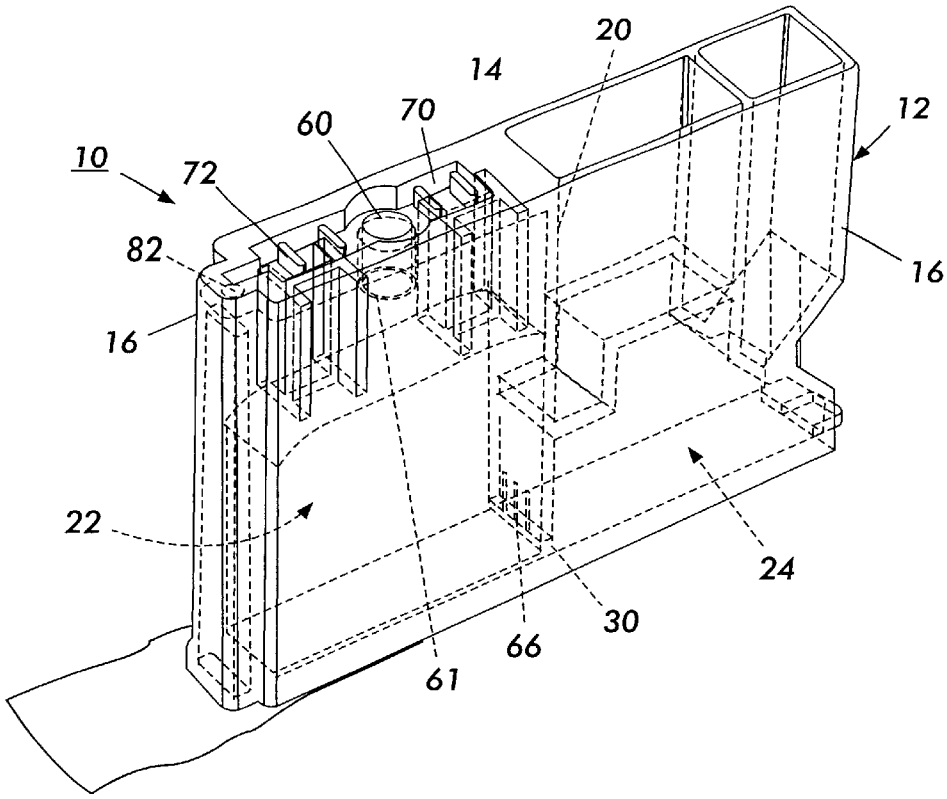
FIG. 1 is a perspective view of an exemplary ink tank incorporating a particular embodiment of the present invention showing the internal structure thereof in phantom.
Figure 2:
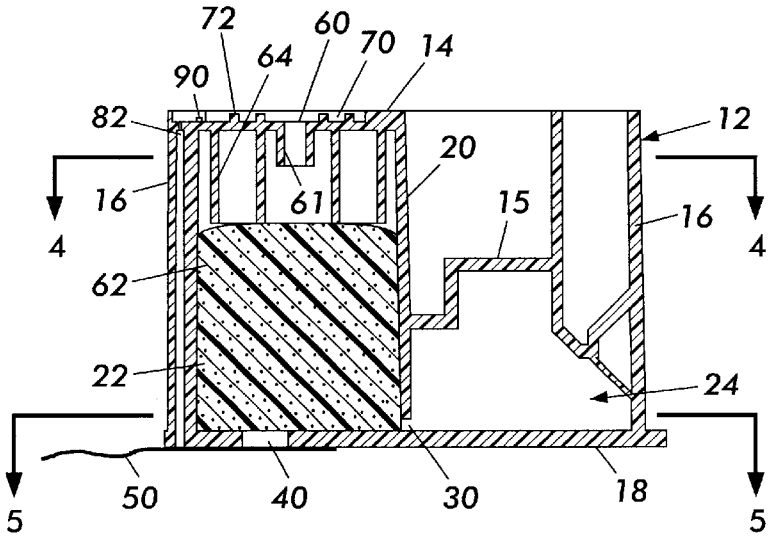
FIG. 2 is a side cross-sectional view of an ink cartridge incorporating the present invention.

Referring to FIGS. 1 and 2, a fluid cartridge 10, specifically an ink cartridge for use with a thermal ink jet printhead, includes a housing 12. In FIG. 1, the internal structure of the cartridge is shown in phantom lines. FIG. 2 is a side view of the cartridge in cross section. The housing is formed of a top wall 14 for one portion, a top wall 15 for another portion, a plurality of side walls 16 (in the illustrated embodiment, four side walls), and a bottom wall 18 to enclose an interior chamber. The top wall 14 of the illustrated embodiment is rectangular, having a long dimension and a shorter dimension. The size of the cartridge is determined by the capacity desired for the housing interior. Although a rectangular shape is shown, other shapes may be used, as dictated by the printhead into which the cartridge is to fit.

In the illustrated embodiment, a divider 20 extending from the top wall 14 toward the bottom wall 18 divides the interior chamber into a wick chamber 22 and a free ink chamber 24. A fluid conduit 30 connects the wick chamber and the free ink chamber. In the illustrated embodiment, the fluid conduit 30 is formed of a gap between the bottom wall 18 of the housing and the bottom edge of the divider wall 20.

The housing walls 16 forming the fluid or ink chamber are integrally formed or sealed so that there is no fluid communication between the fluid chamber and the ambient environment, except through the fluid conduit 30 and the wick chamber 22. In the preferred embodiment, the top and side walls 14, 15, 16 of the housing are integrally formed with no openings except for a single vent opening 60 through the top wall 14 of the wick chamber 22. The top and side walls may be molded of a plastic material such as polypropylene, using injection molding techniques. However, those skilled in the art will recognize that other materials and manufacturing techniques may be used to form the housing.

An outlet opening 40 is formed through one of the walls forming the housing for the wick chamber 22. The outlet opening 40 provides the point at which the cartridge interacts with the remainder of the printhead, and through which ink is supplied from the cartridge to the ink jet printhead. The outlet opening may be through the bottom wall 18 of the wick chamber, which is substantially opposed to the top wall 14. However, the outlet opening may also be provided through one of the side walls 16 of the housing. An outlet opening in one of the side walls is best located in the lower portion of the side wall, near the bottom of the cartridge.

A seal 50 covers the outlet opening 40 until the cartridge is installed in the printhead of the printing apparatus. For example, metallic tape, foil, or other material that the ink cannot penetrate is placed on the outer surface of the wall 18 having the outlet opening 40, to cover the outlet opening and is sealed to the outer surface of the bottom wall. The seal 50 is removable, so that the user can remove it before inserting the cartridge into the printhead. An extended end of the seal 50 extends beyond the end of the bottom wall 18. The user can grasp this extended end to remove the tape from the bottom wall 18 when the user is ready to install the cartridge in the printhead. However, in certain configurations, the seal may remain in place, and be punctured or otherwise penetrated by the printhead when the cartridge is installed for use in the printing apparatus.

A vent opening 60 extends through the top wall 14 of the wick chamber so the pressure inside the wick chamber is the same as the atmospheric pressure of the surrounding ambient environment. Preferably, the ink chamber 24 has no fluid communication with the ambient environment, except through the fluid conduit 30 between the ink chamber and the wick chamber, and thus through the wick chamber. A vent tube 61 extends into the interior of the wick chamber from the vent opening 60.

An ink retaining member, such as a wick 62 substantially fills the interior of the wick chamber 22. Wick material appropriate for use in fluid supply cartridges such as liquid ink cartridges is well understood by those familiar with the art. For example, polyether foam material may be used as the wick 62. When saturated with liquid (such as ink), the wick material facilitates maintaining the negative pressure for proper operation of the printhead. Therefore, the specific material may be different for different print apparatus configurations.

The ink chamber 24 is substantially free of ink retaining material. Liquid ink, stored in the ink chamber 24, is transferred from the ink chamber to the wick 62 through the fluid conduit 30. The ink is released through the outlet opening 40 as necessary to supply the printhead with ink for printing.

Vertical grooves 66 in the wick chamber side of the divider 20 extend upward from the conduit 30. The grooves 66 facilitate the distribution of ink into the wick 62.

Interior structure 64 in the housing prevents the wick material from contacting the vent tube 61 and the vent opening 60. Preventing contact between the wick material 62 and the vent opening 60 reduces potential leakage of ink through the vent opening. Such structure is described in copending U.S. patent application Ser. No. 09/616,383, entitled LIQUID INK CARTRIDGE WITH RECESSED FILL HOLE AND INK TANK VENT, with inventors Dennis M. Lengyel and Hiep H. Nguyen, filed Jul. 14, 2000, and assigned to the same assignee as the present application, which application is hereby incorporated by reference. However, the structure described herein can be successfully used with various cartridge configurations other than the one described in the incorporated patent application.

A fluid conduit extends from the vent opening 60 to another point on the exterior of the ink cartridge housing, preferably near or at the outlet opening 40. In the illustrated embodiment, a first portion of the fluid conduit is formed of a recess 70 in the outer surface of the top wall 14 of the housing. Thus, the vent opening 60 through the top wall of the housing coincides with the recess 70. In accordance with the illustrated embodiment, the recess 70 surrounds the vent opening and is elongate, substantially along the long dimension of the top wall of the housing. In the embodiment illustrated in FIG. 1, the recess encompasses a substantial portion of the top wall of the housing. However, on large cartridges, the recess may encompass only a small fraction of the area of the top wall.

Baffles or islands 72 in the recess have a height equal to the depth of the recess, so that the top of each island is coplanar with the outer surface of the top wall of the housing. Although oval islands are shown, other shapes may be used. Each island extends across only a portion of the recess, so the island does not completely block fluid flow through the recess.

Figure 3:
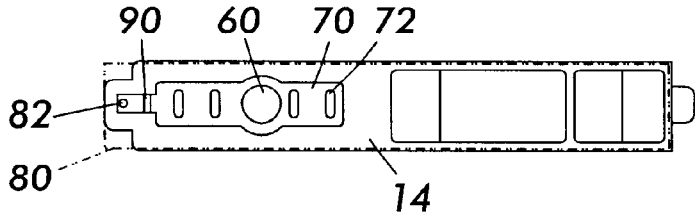
FIG. 3 is a top view of an ink cartridge incorporating the present invention.
Figure 4:
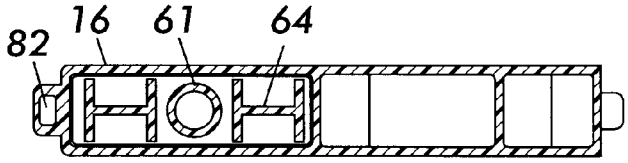
FIG. 4 is a cross-sectional view of an ink cartridge incorporating the present invention, taken along line 4—4 of FIG. 2.
Figure 5:
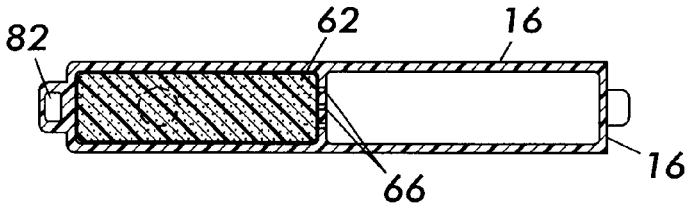
FIG. 5 is a cross-sectional view of an ink cartridge incorporating the present invention, taken along line 5—5 of FIG. 2.
Figure 6:
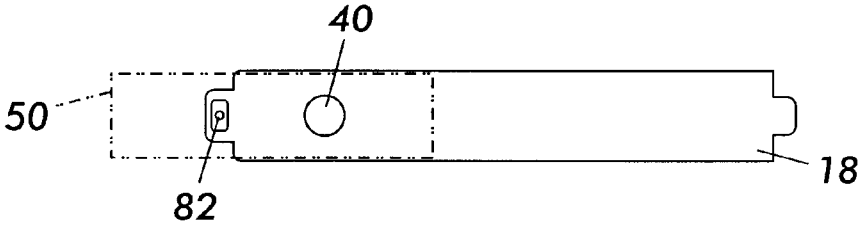
FIG. 6 is a bottom view of an ink cartridge incorporating the present invention.

Metallic tape, foil, or other material 80 (FIG. 3) that is impervious to the liquid ink covers the recess. The tape 80 is attached with adhesive to the raised portions of the outer surface of the top wall that surround the recess. The islands 72 keep the tape 80 from dropping into the recess. In some circumstances, the tape may also be attached to the top surfaces of the islands. Thus, the tape does not seal or close off the vent opening.

One end of the recess 70 communicates with an overflow tube 82 that extends from the recess to another point on the exterior of the housing. The overflow tube 82 forms a second portion of the conduit leading from the vent opening to another point on the exterior of the housing. In one embodiment, a first end of the overflow tube opens into the recess in the top wall of the housing at one end of the recess. The second end of the overflow tube 82 is near the outlet opening 40 from the wick chamber of the housing, which in the illustrated embodiment is through the bottom wall 18 of the housing. The second end of the overflow tube may be 1/8 in (2 mm) from the edge of the outlet opening 40. In the illustrated embodiment, the second end of the overflow tube is in the same plane as the outlet opening. However, other spacings for other configurations will suggest themselves to those skilled in the art. In some arrangements, the outlet opening may be provided through one of the side walls of the housing, and the second end of the overflow tube may be in a different plane, but still proximate the outlet tube. In such arrangements, it is preferred that the overflow tube be formed on the same side wall as is the outlet opening.

The overflow tube 82 extends along one of the side walls 16 of the housing. The overflow tube is integrally formed with the side wall of the housing, preferably as a part of an enlarged side wall. The first end of the overflow tube coincides with the recess in the top wall of the housing.

The upper portion of the overflow tube may comprise a tube of small diameter, such as 0.03 in (0.7 mm), that opens into a wider section ending in a wide second end opening near the outlet opening from the wick chamber. In such a configuration, the overflow tube may be formed of a chamber of the housing interior that has no direct fluid communication with the wick chamber or the ink chamber, communicating only through the vent opening. In another configuration (not shown), the overflow tube may be a small diameter tube along its entire length. The inner diameter of the overflow tube is 0.03 in (0.7 mm). The overflow tube may have a particularly small diameter since the tube does not need to carry a substantial flow of liquid.

With the second end of the overflow tube 82 and the outlet opening 40 proximate one another on the exterior of the housing, and preferably on the same side of the housing, both outlets for ink are in the same region of the housing. Thus, the places on the housing exterior that may have ink on them at some time (the possible "wet" points on the housing) are in the same area, and the user need not be concerned about multiple potential sources of ink when the user is handling the cartridge. This arrangement makes handling the ink cartridge neater for the end user.

In a particular embodiment of the housing, a fluid dam or barrier 90 extends across the width of the recess 70, between the vent opening 60 and the overflow tube 82. In the particular embodiment illustrated, the recess 70 narrows in width in the end having the opening into the overflow tube 82. The dam 90 is placed along the narrow portion of the recess. The dam has a height less than the depth of the recess, so that the dam does not completely block the flow of spill over fluid into the overflow tube. For example, the height of the dam may be one-half to one-third the depth of the recess. The gap between the top of the dam 90 and the tape 80 ensures that the dam does not completely obstruct the flow of spill over fluid into the overflow tube 82.

Prior to filling with ink, the ink chamber 24 and wick chamber 22 are substantially evacuated of air or other gases, so that they contain a vacuum. However, as those familiar with the act will recognize, it is often impractical to obtain a perfect vacuum in a mass manufacturing operation. Therefore, it is almost inevitable that a small amount of air will remain in the ink chamber 24, forming a bubble, and preventing the ink from completely filling the ink chamber.

When environmental changes increase the volume of air in the free ink chamber portion of the cartridge, ink flows through the fluid conduit 30 between the free ink chamber 24 and the wick chamber 22. If the wick material 62 in the wick chamber becomes completely saturated, ink may then fill the space between the top of the wick material and the vent opening 60. Some of the ink may exit the housing interior through the vent opening 60 into the recess 70. The recess receives the ink that exits through the vent opening. The dam 90 contains the ink in the recess, so that it does not flow down the overflow tube 82 and exit the cartridge. This helps maintain the neatness of the outer surface of the cartridge for the user. However, should the environmental changes be extraordinarily large, enough ink may exit through the vent opening that ink may flow over the dam and down the overflow tube. The arrangement described above for the overflow tube directs that ink to the same region of the housing exterior as the outlet tube. Since as the user opens the cartridge, the user expects ink to be present at the outlet opening, the user can be prepared for ink to be at the end of the overflow tube, and need not be concerned with ink in other locations on the exterior of the cartridge.

The structure described above reduces the sudden ejection or squirting of ink when a seal is removed, if the end of the overflow tube 82 has been sealed with the seal 50 that also seals the outlet opening 40, and environmental changes have occurred to create a significant pressure differential between the interior and exterior of the housing. If the external pressure is significantly less than the internal pressure, the increased pressure in the overflow tube 82 prevents the ink from entering the recess in the top wall, or the overflow tube. When the tape 50 covering the outlet of the overflow tube and the outlet opening from the wick chamber is removed, the overflow tube 82 is opened first, before the outlet opening 40. The air in the overflow tube 82 and the recess 70 escapes first, before allowing ink to begin to flow into the recess (if the pressure differential is sufficient). The dam 90 contains ink that enters the recess, so that it does not flow into the overflow tube. In rare cases, sufficient ink may enter the recess that the depth of ink in the overflow tube exceeds the height of the dam, and the ink flows over the dam (through the gap between the top of the dam and the tape), to reach the overflow tube.

A specific embodiment of the present invention has been described. Those skilled in the art after reading the above description will identify various modifications that can be made to the embodiment described above without departing from the spirit of the invention. For example, other shapes of ink cartridges may incorporate the invention. Also, other shapes may be incorporated into the recess and the islands, or other structures may be used, as can different styles of fluid dams or barriers. In addition, the vent opening, the outlet opening, and other elements may be placed in different locations. Therefore, the above description is illustrative, and the scope of the invention is not to be limited to the embodiment described above.

What is claimed:

1. A fluid cartridge for supplying fluid on demand, the cartridge comprising:

a housing having a plurality of walls defining an interior chamber;

a vent opening through one of the housing walls providing fluid communication into the interior chamber;

an outlet opening through one of the housing walls providing fluid communication into the interior chamber; and a fluid conduit having a first end near the vent opening and having a second end near the outlet opening.

2. The fluid cartridge of claim 1, wherein:

one of the housing walls is a top wall;

the vent opening is through the top wall; and the outlet opening is through one of the housing walls other than the top wall.

3. The fluid cartridge of claim 2, wherein one of the housing walls is a bottom wall, and the outlet opening is through the bottom wall of the housing.

4. The fluid cartridge of claim 2, wherein the fluid conduit comprises:

a recess in an outer surface of the top wall adjacent the vent opening; and an overflow tube having a first end at the recess, and having a second end near the outlet opening.

5. The fluid cartridge of claim 1, wherein one of the housing walls is a top wall, and the fluid conduit comprises:

a recess in an outer surface of the top wall adjacent the vent opening; and an overflow tube having a first end at the recess, and having a second end near the outlet opening.

6. The fluid cartridge of claim 5, wherein the recess surrounds the vent opening.

7. The fluid cartridge of claim 5, wherein the second end of the overflow tube is on the housing wall having the outlet opening.

8. A cartridge for supplying ink on demand to an ink-jet printhead, the cartridge comprising:

a housing having a top wall, a bottom wall, and a plurality of side walls all defining a housing interior;

a vent hole through the top wall of the housing, providing fluid communication into the housing interior;

a recess in an outer surface of the top wall of the housing, wherein the recess extends from the vent hole to an edge of the top wall, wherein the recess has a recess depth; and an overflow tube extending from the recess at the edge of the top wall along one of the side walls of the housing.

9. The fluid cartridge of claim 8, additionally comprising an outlet opening through the bottom wall of the housing, wherein the bottom wall is substantially opposed to the top wall.

10. The fluid cartridge of claim 9, wherein an end of the overflow tube is on the bottom wall of the housing.

11. In a cartridge for an ink-jet printhead, the cartridge comprising a housing enclosing an interior chamber, the housing having a vent opening and an outlet opening, a method of controlling ink that flows from the interior chamber through the vent opening, the method comprising:

containing the ink that flows from the interior chamber through the vent opening; and directing the contained ink from the vent opening to a point near the outlet opening.

12. The method of claim 11, wherein the step of containing the ink comprises allowing the ink that flows from the interior chamber through the vent opening to flow into a recess in an outer surface of the housing.

13. A cartridge for supplying ink on demand to an ink-jet printhead, the cartridge comprising:

a housing having a top wall, a bottom wall substantially opposed to the top wall, and a plurality of side walls all defining a housing interior;

a vent hole through the top wall of the housing, providing fluid communication into the housing interior;

an outlet opening through the bottom wall of the housing;

a recess in an outer surface of the top wall of the housing, wherein the recess extends from the vent hole to an edge of the top wall, wherein the recess has a recess depth; and an overflow tube extending from the recess at the edge of the top wall along one of the side walls of the housing, wherein an end of the overflow tube is on the bottom wall of the housing, proximate the outlet opening.

14. The fluid cartridge of claim 13, wherein the recess surrounds the vent opening.

15. In a cartridge for an ink-jet printhead, the cartridge comprising a housing enclosing an interior chamber, the housing having a vent opening and an outlet opening, a method of controlling ink that flows from the interior chamber through the vent opening, the method comprising:

containing the ink that flows from the interior chamber through the vent opening, including the step of allowing the ink that flows to flow into a recess in an outer surface of the housing; and directing the contained ink that flows into the recess from the vent opening to a point near the outlet opening, including the step of flowing the ink through an overflow tube having one end in the recess and the other end near the housing outlet opening.

* * * * *